United States Patent [19]

Brauer et al.

[11] 4,197,841

[45] Apr. 15, 1980

[54] RESPIRATOR WITH PROTECTIVE COVER

[75] Inventors: Lothar Brauer; Klaus Pampuch, both of Berlin, Fed. Rep. of Germany

[73] Assignee: Auergesellschaft GmbH, Berlin, Fed. Rep. of Germany

[21] Appl. No.: 908,094

[22] Filed: May 22, 1978

[51] Int. Cl.[2] ..... A62B 7/10

[52] U.S. Cl. ..... 128/202.13; 128/204.26; 128/201.13

[58] Field of Search ..... 128/142 R, 142.2, 142.3, 128/142.4, 142.6, 146 R, 146.2, 146.3, 146.6, 146.7, 212, 205, 195

[56] References Cited

U.S. PATENT DOCUMENTS

| | | | |
|---|---|---|---|
| 3,938,512 | 2/1976 | Mansteller et al. | 128/146.6 X |
| 4,146,025 | 3/1979 | Warncke et al. | 128/146.3 X |

FOREIGN PATENT DOCUMENTS

| | | | |
|---|---|---|---|
| 72784 | 2/1944 | Czechoslovakia | 128/142.4 |

*Primary Examiner*—Henry J. Recla

*Attorney, Agent, or Firm*—Brown, Flick & Peckham

[57] ABSTRACT

Exposed components, including an exhalation valve, of a respirator mask are protected from extremely cold temperatures by a bag containing them, with its open end held in sealing engagement with the portion of the mask adjacent the components by means of a flexible collar. The bag is provided with an air inlet and with air outlets isolated from the inlet for escape of exhaled air from the bag. When one of the mask components in the bag is a filter, its inlet side is covered by an air-permeable base portion of the bag, and the rest of the bag is made of air-impermeable material, with the junction of the two parts of the bag sealed against the filter.

5 Claims, 3 Drawing Figures

RESPIRATOR WITH PROTECTIVE COVER

Figure 1:
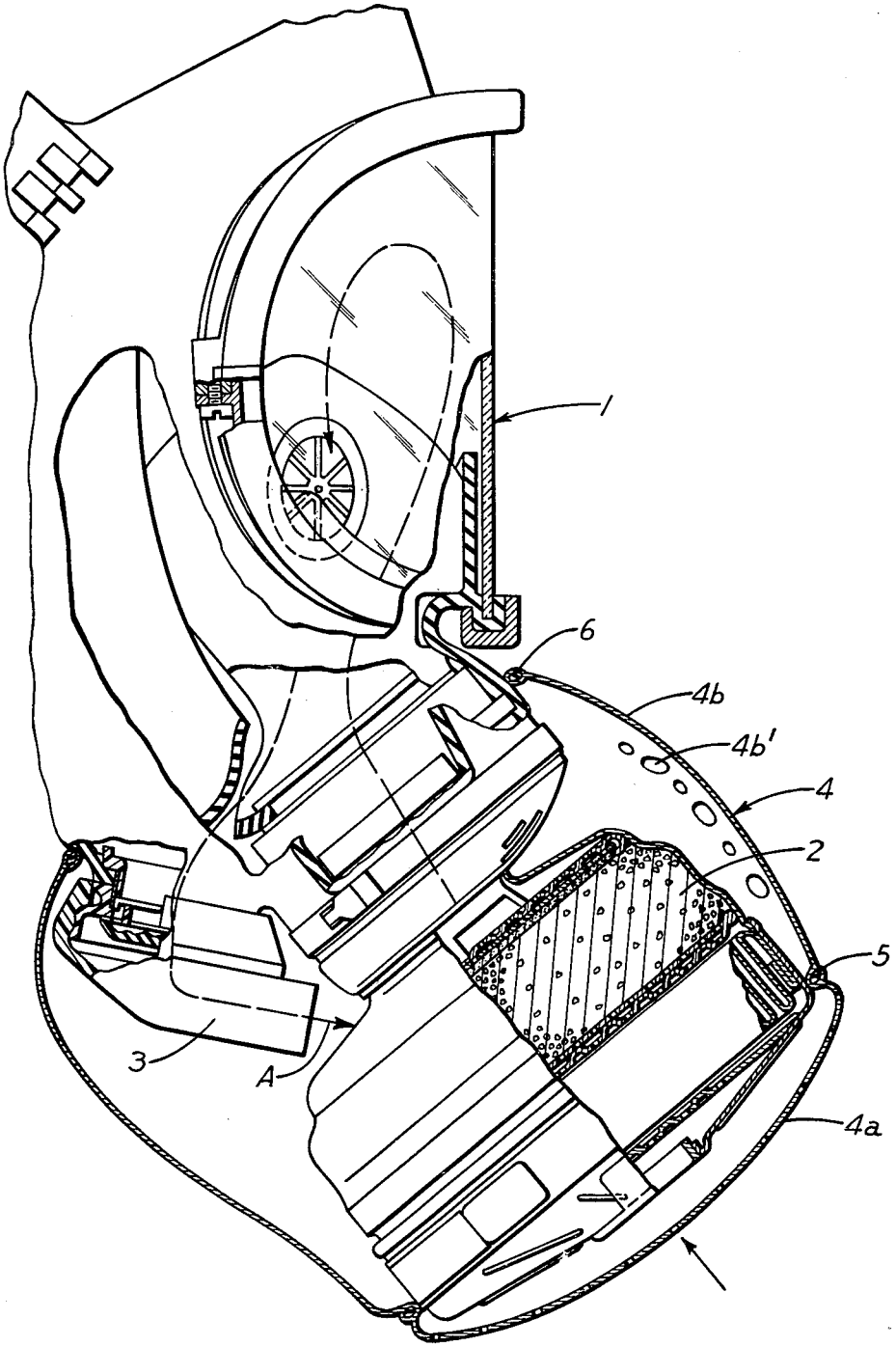

The invention concerns a respirator which is to be used, in particular, in an extremely cold environmental atmosphere.

It has been found that when respiratory protection devices are used during the cold season, the externally accessible operating parts serving various functions such as, for example, the respiration filter and exhalation valve, or the automatic lung, are subjected by the surrounding cold air or by snow to particularly high loads that can reduce the ability of the respirator to function. If, for example, a filter is employed, it is possible that when the surrounding atmosphere is cold, snow and ice crystals will form or be found on the external side of the filter admitting the inhaled air. Or, if cooling is too strong while the reaction is proceeding rapidly and going to completion, the production of the required oxygen by the filtering and oxygen regenerating materials in the filter can be blocked. In addition, the ability of the exhalation valve to function can be impaired if the surrounding atmosphere is too cold. This can likewise occur when using a respiratory device of the reservoir tank type and also an automatic lung.

In order to protect the filter against fouling or premature blockage by coarse dust in the case of respiratory protection devices fitted with a filter, it has been proposed to provide a filter-protection bag mounted in front of the filter cartridge. This known arrangement, however, is preferably employed, for example, in paint-spraying operations.

The principal object of this invention is to create a respiratory protection device constructed in such a way that those functional parts of the apparatus which are accessible from the outside, such as the filter, the exhalation valve or the automatic lung, or other such parts, are not subjected to cooling that is so severe that the ability of the respirator to function would be impaired on account of the environmental air being extremely cold or by the presence of snow or ice. Another object is to provide such a device, in which the respiratory filter can be protected before being clogged by ice crystals.

These objects are attained in accordance with this invention by completely enclosing the components of the respirator that are accessible from the outside by a protective cover that is made essentially in the form of a bag, the protective cover being made from an air-impermeable jacket with an air-transmitting base fastened to one end of it, there being provided a flexible collar that acts as a connection between the base and the jacket. A second flexible collar at the open end of the bag surrounds a portion of the respirator mask and seals the bag against it. A small area of one side of the air-impermeable jacket is provided with a number of exhalation openings.

The advantages to be gained by means of the invention reside, in particular, in the fact that the respiratory protection device can be adapted by simple means for operation during the cold season while still maintaining the high operating efficiency required from such a device.

Figure 2:
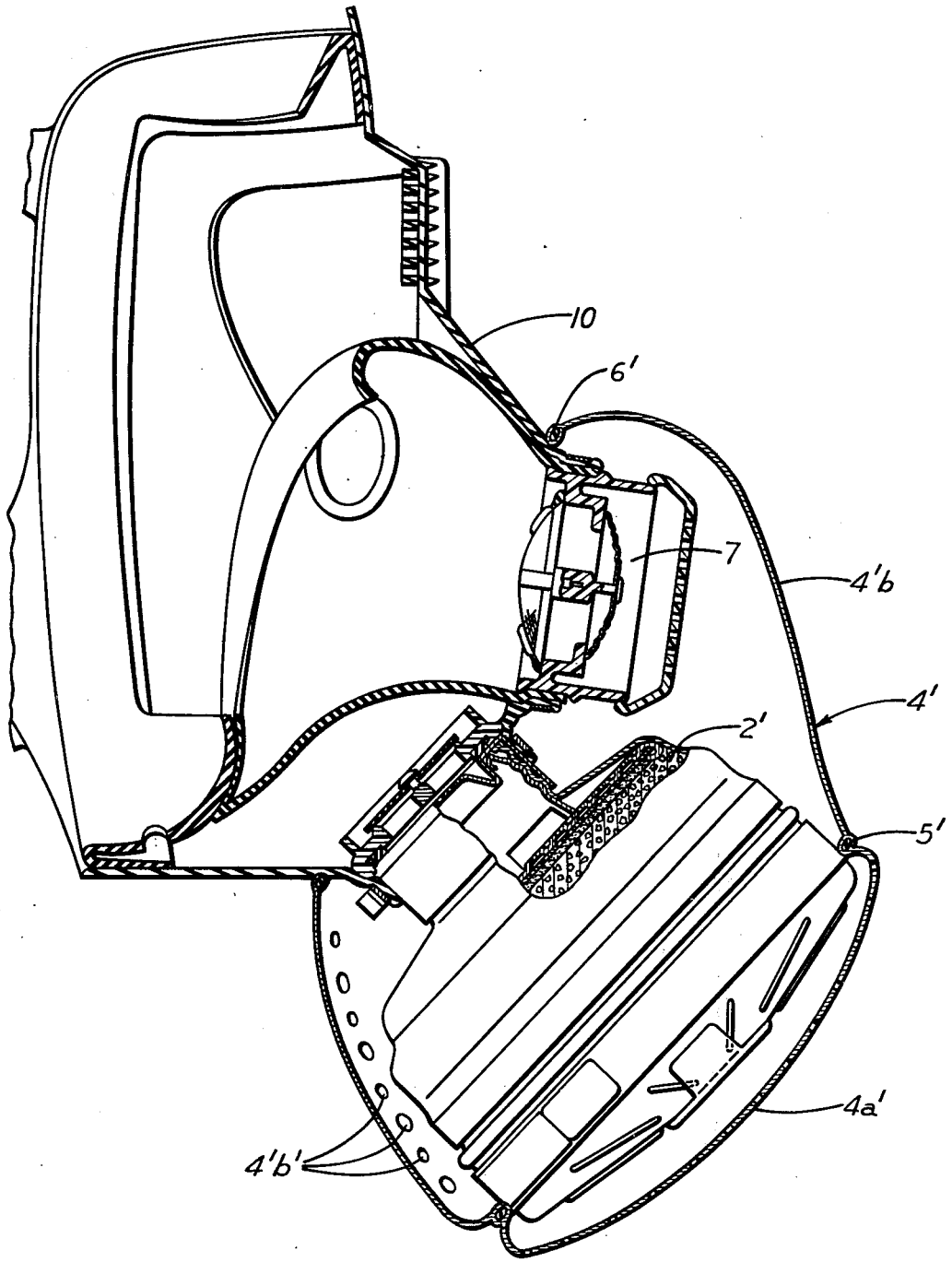
Figure 3:
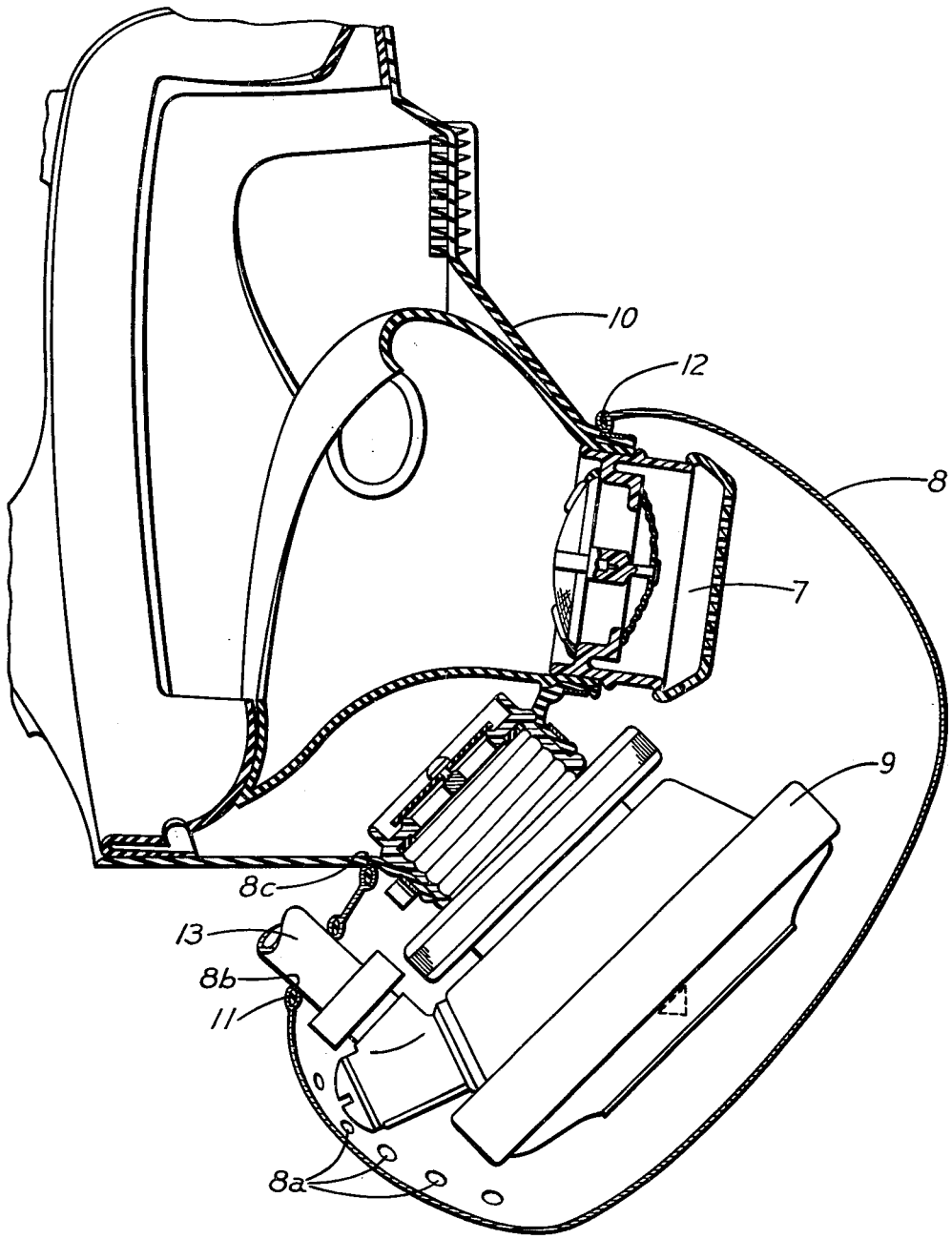

The appended drawings illustrate by way of example three constructions which are in accordance with this invention and which are described in greater detail in the following, where:

FIG. 1 is a side view of a respirator, partly broken away in vertical section; and FIGS. 2 and 3 are vertical sections through two different modifications of the invention.

Referring to FIG. 1 of the drawings, a respirator mask 1 carries a respirating filter 2 and is provided with an exhalation valve 3 behind the filter. In order to be able to use a respirator of this type when the surrounding atmosphere is extremely cold, as in winter, for example, without at the same time cooling too severely both exhalation valve 3 and filter 2, which upgrades the air being inhaled, and also in order to prevent such cooling from causing the external face of the filter to be blocked by ice crystals, the exhalation valve and filter are enclosed in a protective cover 4 made in accordance with the invention. In effect, this cover is in the form of a bag that is assembled from two parts; namely, an upper sleeve-like jacket **4*b* and a base 4*a*** connected to its lower end.

Corresponding to their different functions, the two parts of the bag are made from different materials. Thus, the base **4*a* consists of an air-permeable cover for the inlet side of the filter, whereas the jacket 4*b* is made of a material that is impermeable to air in order to serve as a kind of exhalation bag. The junction between the two parts 4*a* and 4*b* of the bag 4 is accomplished by means of a flexible collar 5 or by a flat clamping spring secured in the edge of the air-transmitting base 4*a* and also in the adjoining edge of the air-impermeable jacket 4*b*. In order to be able to pull this bag-like protective cover over the components of the respiratory protection device to be protected and to form a tight seal with the mask, a flexible collar 6 or a flat spring-band is secured to the open end of the bag and holds it in sealing engagement with the surrounding portion of the mask without any need for any special means of attachment. Flexible collar 5 clamps the bag firmly against the encircled lowest part of the side wall of filter 2**, whereby the bag forms two chambers; one above the filter and one below it.

In accordance with the invention, the air-impermeable jacket **4*b* of the bag is provided in its side opposite or furthest removed from exhalation valve 3 with one or more so-called exhalation holes 4*b*', through which exhaled air can leave the bag after first passing through the valve in the direction of arrow A. It is evident from this that the exhaled air flows through jacket 4*b* in an advantageous manner around the parts of the respirator to be protected from cold and flushes them with warm air which considerably hinders the cooling of these parts. In order to make quite sure that the exhaled air is permitted to leak out only through the holes 4*b*', the flexible collar 5 serves advantageously as a seal that prevents access to base 4*a***.

Base **4*a*, which is made as a coarse filter, consists, for example, of a fleecy woolen material or of a synthetic sponge material, while the air-impermeable exhalation jacket 4*b*** can consist, for example, of a solid sailcloth or of a life-saving jacket material. Both types of material should be nonflammable.

In FIG. 2 there is shown a more developed form of respiratory protection apparatus, in which a mask 10 is provided with an exhalation valve 7 located above a filter 2'. As in the case of the respirator first described, the protective cover or bag 4', which is made in accordance with this invention and which covers the exposed parts of the respirator, is drawn over them in such a way that the exhaling holes **4'*b*' in the jacket 4'*b* of air-impermeable material are located as far as possible from the exhalation valve. The jacket is attached to the mask and filter in the same way as described for FIG. 1, by flexible collars 6' and 5'**.

A still further embodiment of the invention is disclosed in FIG. 3, wherein a protective cover made in accordance with the invention and which constitutes winter equipment is used in conjunction with a mask 10 provided with an exhalation valve 7 and an automatic lung 9 for compressed air breathing. As may be seen in the drawing, in this case the protective cover consists solely of a bag 8 made from air-impermeable material and which completely encloses the automatic lung and the exhalation valve, thereby enabling the stream of warmed-up exhaled air to circulate around these parts and then pass out into the outside air through a suitable number of exhalation holes **8*a* located in the bag below the automatic lung. It is evident from this description that, during winter operation, the exhalation valve and the automatic lung will not become unduly cooled. However, in this construction of the air-impermeable bag 8, it must be provided with a suitable opening 8*b* for the automatic lung's compressed air delivery tube 13. Opening 8*b* is provided with a flexible peripheral collar 11 which acts as a seal against tube 13 which extends out of the bag. Similarly, a flexible collar 12 around the bag opening 8*c* for the mask acts as a sealing ring against the mask. When the exhalation bag is drawn over the automatic lung and exhalation valve, flexible collar 12 slides firmly onto mask 10**, forming with it a gas-tight seal.

Advantageously, a special cold-resistant material is selected for the flap of each of the exhalation valves shown herein in order to provide additional assurance that the valve will open and function reliably under conditions of extreme cold.

We claim:

1. The combination with a respiratory protection device in the form of a mask provided with an exposed exhalation valve and an exposed intake conduit member through which air is conducted into the mask, of a protective cover for said member and valve comprising a protective bag containing them and having an end opening receiving the portion of the mask surrounding them, a flexible collar engaging the bag around said opening and sealing the bag against said mask portion, said conduit member having an inlet portion for receiving air from outside the bag, and a second flexible collar engaging the bag and sealing it against said inlet portion, the bag being provided with air outlets located remotely of said valve, said air outlets being isolated by said second collar from said conduit member inlet portion, and said exhalation valve being positioned to discharge exhaled air into the bag remotely from said outlets to warm said conduit member and valve when said device is used in a cold atmosphere.

2. The combination recited in claim 1, in which said air outlets in the bag are so located relative to said exhalation valve as to cause exhaled air from said valve to flow around said conduit member.

3. The combination recited in claim 1 or 2, in which all of said bag is made of air-impermeable material, said conduit member is an automatic lung and said conduit member inlet portion comprises an inlet tube for compressed air extending out of said bag, and said second flexible collar seals the bag against said tube.

4. The combination recited in claim 1, in which said air outlets in the bag are disposed in the side of the bag farthest removed from said exhalation valve.

5. The combination recited in claim 1, in which said conduit member contains an air filter and said bag includes a sleeve-like jacket surrounding said member and valve and made of air-impermeable material and an air-permeable base member at one end of the jacket covering said conduit member inlet portion, said air outlets are in the side of the jacket, and said second flexible collar is located at the junction of the jacket and said base member.

* * * * *